US006792725B1

(12) United States Patent
Rutherford

(10) Patent No.: US 6,792,725 B1
(45) Date of Patent: Sep. 21, 2004

(54) VENT DEVICE FOR A WALL STRUCTURE

(75) Inventor: Barry Rutherford, Chatsworth, CA (US)

(73) Assignee: Flannery Inc., San Fernando, CA (US)

( * ) Notice: Subject to any disclaimer, the term of this patent is extended or adjusted under 35 U.S.C. 154(b) by 0 days.

(21) Appl. No.: 10/238,086

(22) Filed: Sep. 10, 2002

(51) Int. Cl.[7] ..... E06B 7/14
(52) U.S. Cl. ..... 52/209; 52/302.3
(58) Field of Search ..... 52/209, 302.3; 454/254

(56) References Cited

U.S. PATENT DOCUMENTS

| | | | | | |
|---|---|---|---|---|---|
| 636,982 | A | | 11/1899 | Hanna, Jr. | |
| 3,318,056 | A | | 5/1967 | Thomson | |
| 3,748,803 | A | | 7/1973 | Widerby et al. | |
| 4,129,972 | A | | 12/1978 | Sherman et al. | |
| 4,245,443 | A | * | 1/1981 | Beechen | 52/169.5 |
| 4,277,926 | A | | 7/1981 | Sherman et al. | |
| 4,393,633 | A | | 7/1983 | Charniga | |
| 4,607,566 | A | * | 8/1986 | Bottomore et al. | 454/260 |
| 5,826,388 | A | | 10/1998 | Irving | |
| 5,890,331 | A | * | 4/1999 | Hope | 52/209 |
| 5,921,038 | A | * | 7/1999 | Burroughs et al. | 52/209 |
| 6,044,600 | A | * | 4/2000 | McCollough | 52/209 |
| 6,101,775 | A | * | 8/2000 | Larimore | 52/302.1 |
| 6,108,992 | A | | 8/2000 | Shaw | |
| 6,298,609 | B1 | * | 10/2001 | Bifano et al. | 52/58 |
| 6,298,620 | B1 | | 10/2001 | Hatzinikolas | |
| 6,385,925 | B1 | * | 5/2002 | Wark | 52/209 |
| 6,449,915 | B1 | * | 9/2002 | Park | 52/407.1 |
| 2001/0054263 | A1 | | 12/2001 | Coulton | |
| 2002/0026762 | A1 | | 3/2002 | Charland | |

* cited by examiner

*Primary Examiner*—Harold Joyce
(74) *Attorney, Agent, or Firm*—Christie, Parker & Hale, LLP

(57) ABSTRACT

A vent device for overcoming the problem of moisture accumulating within a wall structure. The vent device promotes air and moisture circulation within the wall structure by having a channeling plate with a plurality of vertically oriented channels. The vent device also has a support flange adjoined to the channeling plate. The vertically oriented channels define a passageway for air and water to travel along when the vent device is disposed within the wall structure. The channeling plate is adapted for being positioned between a horizontal joist and a wallboard of the wall structure. When the vent device is positioned within the wall structure, the passageway allows air and moisture to travel between the horizontal joist and the wallboard.

11 Claims, 5 Drawing Sheets

VENT DEVICE FOR A WALL STRUCTURE

FIELD OF THE INVENTION

The present invention relates to a vent device for a wall structure, and more specifically to a vent device for permitting the passage of air and moisture between a horizontal floor joist and a wallboard.

BACKGROUND OF THE INVENTION

Problems in residential and commercial buildings often result from moisture build-up within wall structures. Accumulation of moisture within a wall structure can cause various portions of the structure to rot, and can lead to the growth of mold. It is well-known that certain types of mold have very serious health impacts on persons of all ages. The presence of mold in homes and in the work place has caused many illnesses and many lawsuits. As a result, growing attention is being given to both the remediation and prevention of mold in buildings.

Mold is typically formed in buildings by moisture that has been allowed to accumulate in the wall structure. For example, a typical residential wall structure includes a series of two inch by four inch (i.e. 2×4 in.) vertical wall joists (i.e. studs) that span the length from the floor to the ceiling, and are spaced 16 inches on center. A series of horizontal wall joists—also 2×4 in.—span across the top of the vertical joists (i.e. the ceiling joists) and along the bottom of the vertical joists (i.e. the floor joists). Other horizontal joists are commonly positioned between the floor and ceiling to define areas such as door and window frames. A finished wall structure is achieved by attaching some type of wallboard onto the horizontal and vertical joists. Depending on whether the wall is intended to serve as an exterior wall or an interior wall, different wallboard materials can be used. The wallboard is typically attached directly to an underlying 2×4, and can be made from a variety of suitable materials such as plasterboard, sheet rock, dry wall, stucco, and various types of wood or synthetic siding.

By attaching the wallboard directly to the wall joists, a series of separate generally sealed areas are formed between the horizontal and vertical joists and the wallboard. These sealed areas result in substantial containment of any air or water that is within the particular area. Accordingly, when moisture enters one of these areas, the moisture is not permitted to travel to another area, nor is air able to flow therein to help evaporate the moisture. The moisture typically remains in the area and forms along the surface where the horizontal joists and the wallboard adjoin, which makes this area a common location for mold problems.

This description of a residential wall structure is merely an overview of the type of wall structures common in residential and commercial construction. Many other materials and sizes of materials can, and are, used in such structures. However, in most constructions there is a problem with moisture accumulating where the wall joists and wallboards adjoin because of the lack of air and moisture flow.

Moisture often enters the inside of a wall structure from the outside environment from sources such as poorly sealed windows or doors, cracks in the wallboard, or sources such as leaking pipes. Also, depending on the climate, heat differentials between the outside temperature and inside temperature can create condensation build-up along the exterior and/or interior wall surfaces. Any source of moisture within the wall structure can lead to structural damage and mold, unless there is adequate means for the moisture to either evaporate or exit the structure.

There exists a need for a device that can be used in conjunction with existing construction and building practices to provide a means for allowing moisture and air to pass within the wall structure to prevent moisture damage and mold. More specifically, there exists a need for a device that can be used to solve the problem of moisture accumulating within the wall structure where the wall joists and wallboard adjoin.

SUMMARY OF THE INVENTION

The present invention relates to a vent device that helps overcome the problem of moisture accumulating within a wall structure. The vent device promotes air and moisture circulation within the wall structure by having a channeling plate with a plurality of vertically oriented channels. The vent device also has a support flange adjoined to the channeling plate. The vertically oriented channels define a passageway for air and water to travel along when the vent device is disposed within the wall structure.

The channeling plate also comprises a mounting surface and a venting surface facing opposite the mounting surface. The venting surface comprises the vertically extending channels. The channeling plate is adapted for being positioned between a horizontal joist and a wallboard of the wall structure. When the vent device is positioned within the wall structure, the passageways provided by the vertically oriented channels allows air and moisture to travel between the horizontal joist and the wallboard.

The vent device can include various sizes and shapes, and be made from any materials suitable for such construction.

DETAILED DESCRIPTION

A vent device according to the present invention generally comprises a channeling plate having a plurality of vertically oriented channels that create a passageway within a wall to structure prevent moisture accumulation. More particularly, the vent device is adapted for placement between a wall joist and a wallboard so that the vertically oriented channels provide a passageway for air and moisture to travel therebetween.

Referring to FIG. 1, a vent device 10 is shown. The vent device 10 comprises a channeling plate 12 having a plurality of vertically oriented channels 14, and a support flange 16 adjoined to the channeling plate. The vent device is shown having an L-shaped configuration wherein the channeling plate 12 and support flange 16 are integrally adjoined in a substantially perpendicular manner.

Figure 1B:
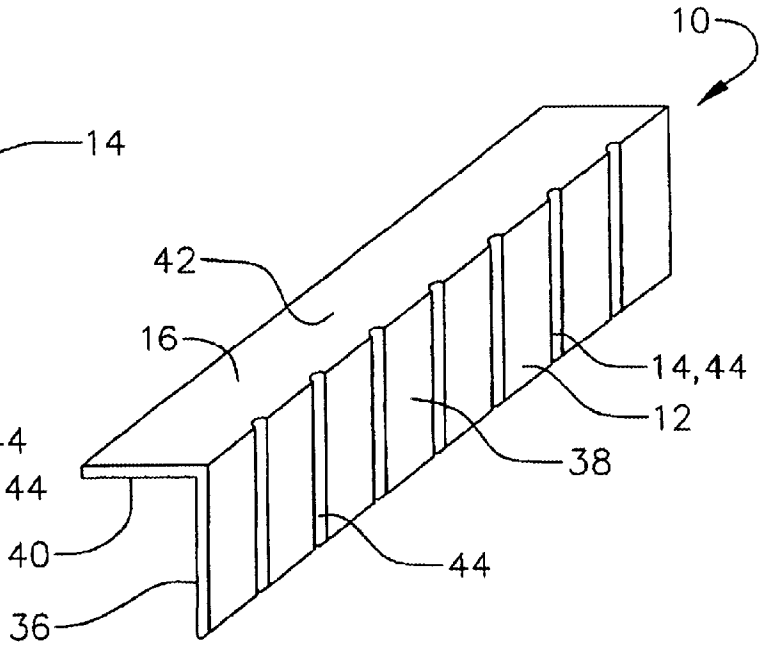
FIG. 1*b* shows a perspective view of the vent device of FIG. 1, wherein the vent device has been rotated for a different installation position.
Figure 2:
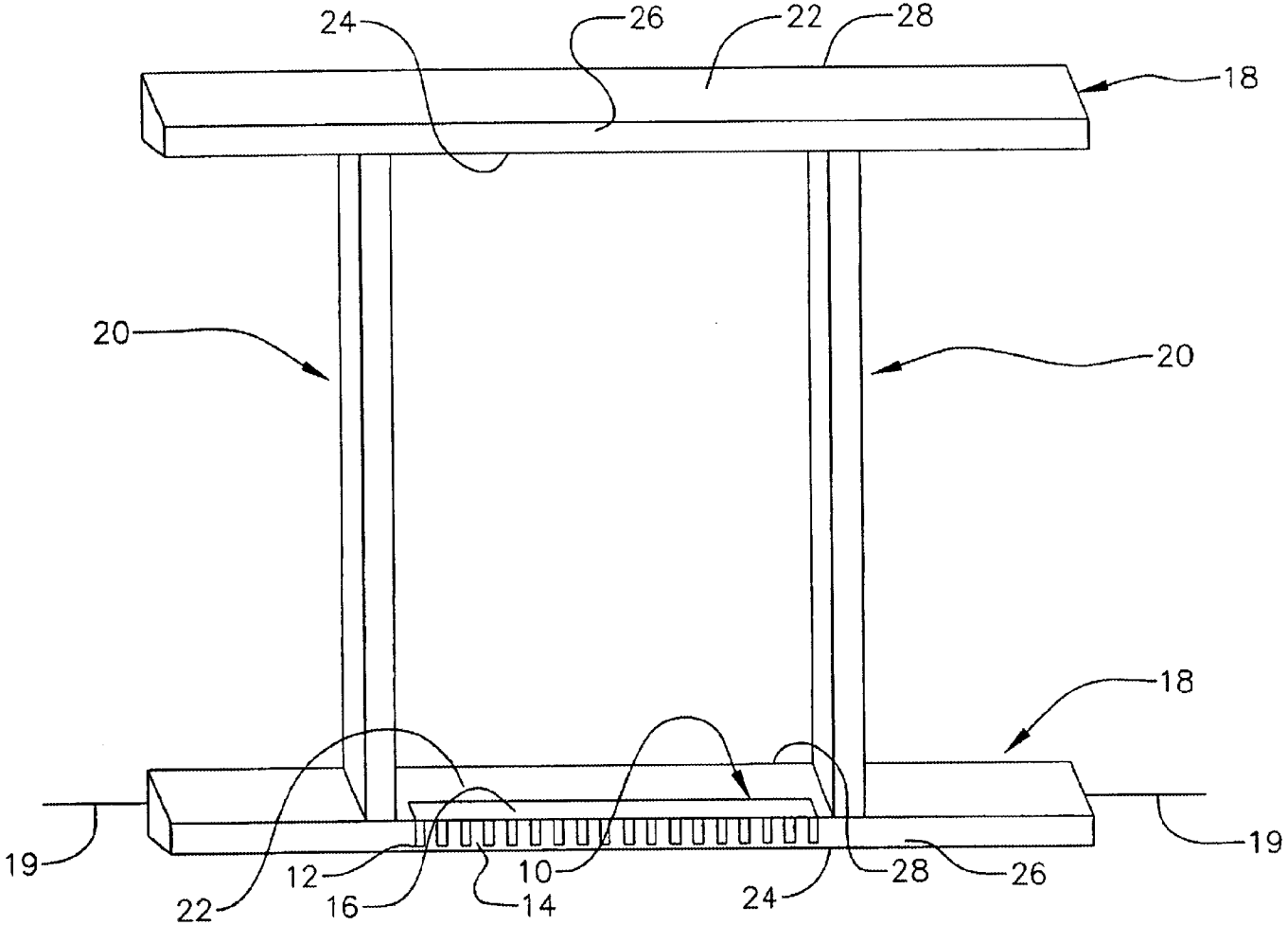
FIG. 2 shows a sample wall structure construction having the vent device of FIG. 1*b* mounted thereon.

The vent device 10 is designed to be positioned between a horizontal wall joist and a wallboard. FIG. 2 shows a sample construction of a wall structure having the vent device 10 of FIG. 1*b* mounted thereon. The wall structure comprises a first horizontal joist 18 positioned horizontally along a floor 19 (defining a floor joist), and a second horizontal joist 18 positioned horizontally above the floor (defining a ceiling joist). A plurality of vertical joists 20 span the distance between the horizontal joists. Each of the horizontal joists comprises a top surface 22 and a bottom surface 24 facing opposite the top surface. The vertical joists can be positioned at repeated intervals between the top surface 22 of the floor joist and the bottom surface 24 of the ceiling joist. The horizontal joists also comprise a front surface 26 and a back surface 28 facing opposite the front surface. The front surface 26 is the surface to which a wallboard is attached to complete the wall structure.

Figure 3:
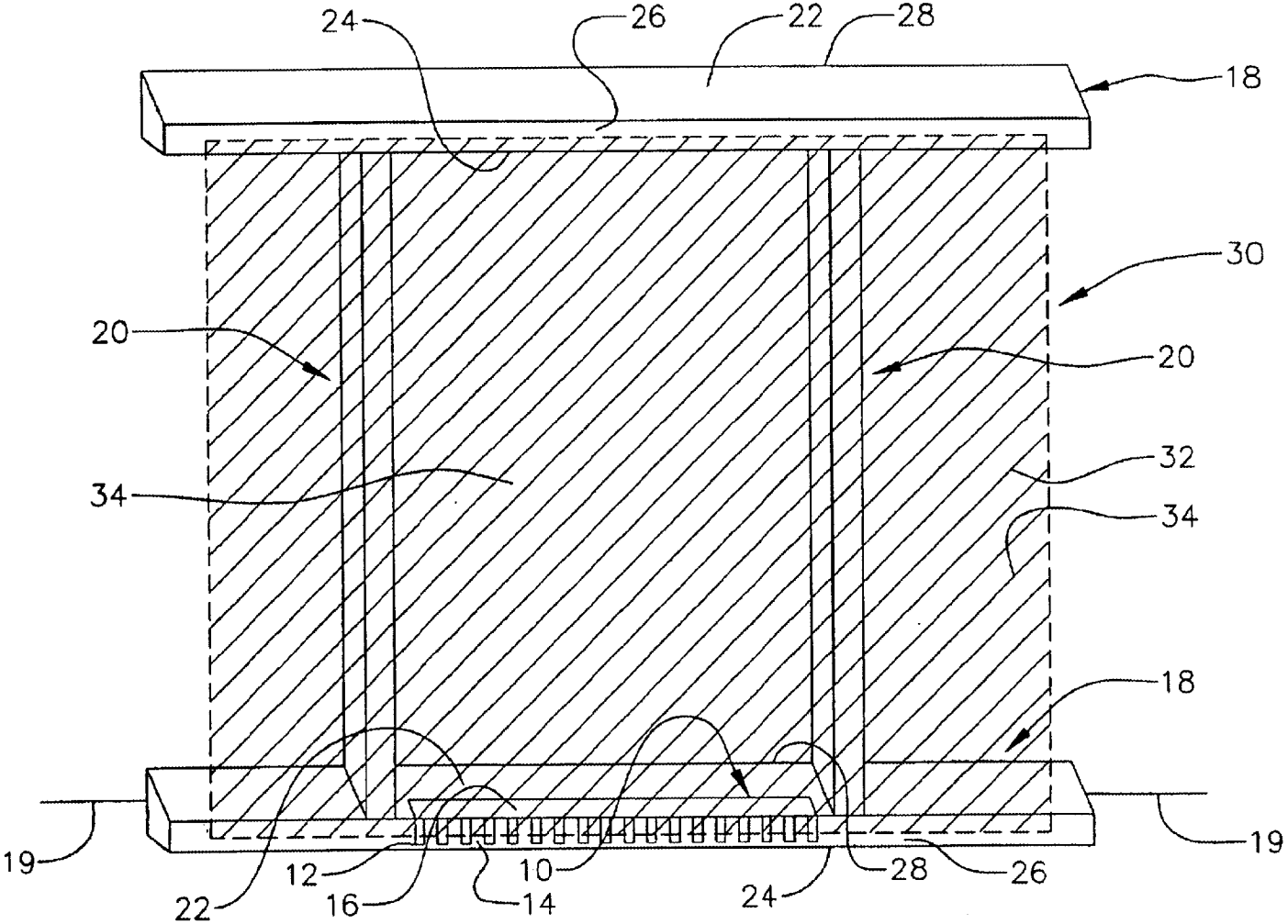
FIG. 3 shows the wall structure of FIG. 2 further comprising a wall board positioned thereon.

FIG. 3 shows the wall structure of FIG. 2—having the vent device mounted thereon—further comprising a wallboard 30 attached to the front surface 26 of the horizontal joists 18 and over the vent device. The wallboard is shown in shadow to show the relative positioning of the horizontal and vertical joists. The wallboard is generally made part of the wall structure by attaching it to the horizontal joists and/or the vertical joists by fasteners such as nails or screws. The wallboard 30 can be made from any material suitable for forming a wall surface, such as plasterboard, drywall, sheet rock, a sheathing, or the like. The wallboard comprises an inner surface 32, which is the surface that adjoins to the front surface 26 of the horizontal joists, and an outer surface 34, which is surface that defines either an exterior or interior wall surface of a building. When the wallboard 30 is attached to the horizontal joists, a generally "sealed" area is formed between the wall joists, which substantially contains air and moisture within the area. As noted above, there is a problem with moisture accumulating along the areas where the horizontal joists and the wallboards are adjoined.

The vent device 10 is designed to fit between adjacent surfaces of the horizontal joists and the wallboard to provide a passageway for air and moisture to travel, so that moisture accumulation and the resulting problems can be avoided. More specifically, the vent device is positioned between the front surface 26 of the horizontal joist 18 and the inner surface 32 of the wallboard 30.

Referring to FIGS. 1 to 3, the channeling plate 12 of the vent device 10 further defines two surfaces relative to the horizontal joist and the wallboard, namely a mounting surface 36 facing towards the front surface 26 of the horizontal joist, and a venting surface 38 facing towards the inner surface 32 of the wallboard and opposite the mounting surface. The mounting surface provides a substantially flat surface for the vent device to rest firmly against the horizontal joist. The venting surface includes the vertical channels 14 and is intended to create a flow path between the horizontal joist and the wallboard.

Figure 1A:
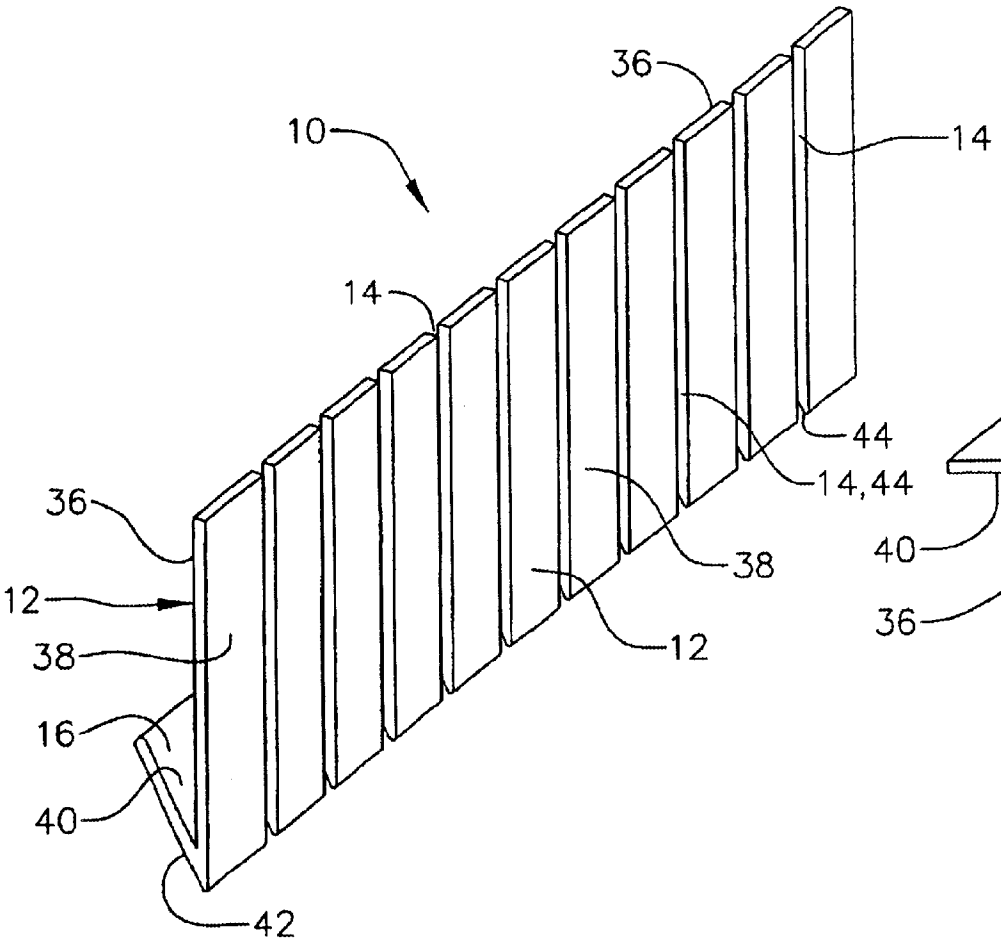
FIG. 1*a* shows a perspective view of a vent device of the present invention.

The support flange 16 of the vent device has an interior surface 40 that is designed to rest along the top surface 22 of the horizontal joist, or along the bottom surface 24 of the horizontal joist. Because the vent device can be used with the horizontal joist when it is serving as either the floor joist or the ceiling joist, the vent device can be oriented differently depending on which horizontal joist it is being used with. This is shown in FIGS. 1*a* and 1*b*, where the same vent device is oriented/rotated differently to provide different mounting positions. Thus, when adjoining the vent device to the floor joist, the interior surface of the support flange can be rested against either the top surface 22 or the bottom surface 24 of the horizontal joist. The same is true for the ceiling joist, but it may be more practical to place the support flange on the top surface of the ceiling joist because it can be placed over the top surface of the ceiling joist and rest in that position without additional attachment means. Also, the vent device can be used with any other horizontal joist in the wall structure positioned between the floor and ceiling joists.

When the interior surface 40 of the support flange is positioned along the top surface or bottom surface of the horizontal joist, and the channeling plate is positioned between the front surface of the horizontal joist and the inner surface of the wallboard, a passageway 44 is formed. The passageway 44 is a flow path defined along the vertically oriented channels 14 of the venting surface 38 of the channeling plate. The passageway provides a sufficient space and area between the horizontal joist and the wallboard to allow moisture captured within the wall structure to circulate or exit. More specifically, moisture is prevented from accumulating between the inner surface 32 of the wallboard and the top surface of the horizontal joist because air and moisture are permitted to travel along the channels 14. Furthermore, the presence of the passageway/channels enables additional air circulation, which can prevent moisture accumulation in other areas of the wall structure as well.

The depth or thickness of the channels 14 can be varied depending on the particular application. The depth or thickness of the channels/passageways is defined by the thickness of the channeling plate, which is defined by the distance between the mounting surface 36 and the venting surface 38. The channels/passageways can be configured to provide the desired venting performance, yet also sufficient to prevent entry to unwanted insects (i.e. ants). One sufficient range of thickness is from 12 to 20 thousands of an inch, with 16 thousands of an being be preferred.

The channeling plate 12 preferably has a length sufficient to cover the height of the horizontal joist, which is defined by the height of the front surface 26. For instance, in the floor joist, the front surface 26 defines the height that the horizontal joist rests above the floor, as measured between the top surface and the bottom surface. Accordingly, if the vent device 10 is positioned over the floor joist by having the support flange 16 positioned under the floor joist, (i.e. between the floor 19 and the bottom surface 24 of the floor joist) and the channeling plate along the front surface of the floor joist, then it is preferred that the channeling plate will span the entire height of the floor joist. This maximizes the length of the vertical channels. Also, the width of the channels should be sufficient to transport moisture and/or condensation. Moreover, the vent device 10 can be made from any suitable structural material, such as vinyl, aluminum, plastics, rubber, etc.

Figure 4:
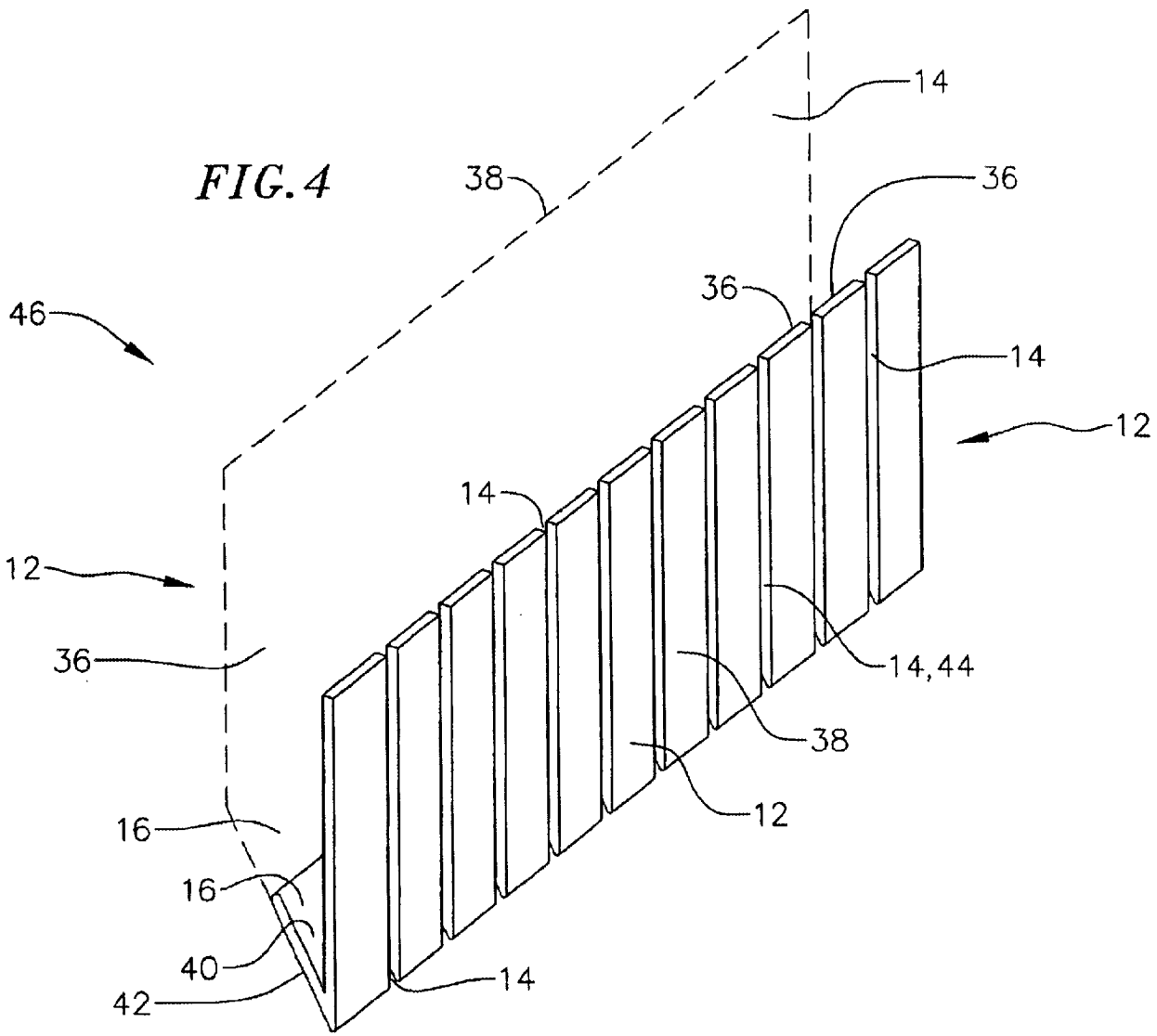
FIG. 4 shows another vent device of the present invention having a U-shaped configuration.

Another embodiment of the present vent device is shown in FIG. 4. Here, a vent device 46 is shown having a U-shaped construction. The vent device 46 has the same general construction and properties as the vent device 10, and therefore, will use the same reference numeral to denote like parts. Basically, the vent device 46 can be seen as two L-shaped vent devices 10 that are interposed towards each other and adjoined at their support flanges 16 to form a single U-shaped device. More specifically, the vent device comprises a pair of channeling plates 12 (the second shown only in shadow), each having the same construction including a plurality of vertically oriented channels 14, and a support flange 16 that adjoins the channeling plates.

The support flange 16 should be sized to span the depth of the horizontal joist. In other words, the support flange 16 should be able to cover either the entire top surface 22 or bottom surface 24 of the horizontal joist. By doing so, the vent device can provide the channeling plates along both the front surface 26 and the back surface 28 of the horizontal joist. This enables the vent device to provide its benefits to both wall surfaces of the wall structure (i.e. the single vent device can provide benefits to more than one room, or both an exterior and an interior wall). The U-shaped vent device 46 otherwise has all of the same features as the vent device 10 described above.

The installation of the present vent device can occur either prior to installing the horizontal joist in a wall structure (i.e. first attach the vent device to the horizontal joist), or after the horizontal joist has been installed and prior to the wallboard having been adjoined. This makes retrofitting a project with the present vent devices quite simple. The vent device can be adjoined at the same time the wallboard is being adjoined to the joists, and can even be adjoined by using the same fastening means that are already being used to secure the wallboard. Thus, the vent device can easily be incorporated into any ongoing construction.

Furthermore, the vent device can be made in any size or shape to accommodate the materials being used for a specific project. Although the vent device has been discussed with respect to the standard wall joists having a 2×4 in. construction, it is understood that the invention is equally applicable to other sized joists and other types of materials, and can be used in any construction where moisture damage and mold are a concern.

Figure 5:
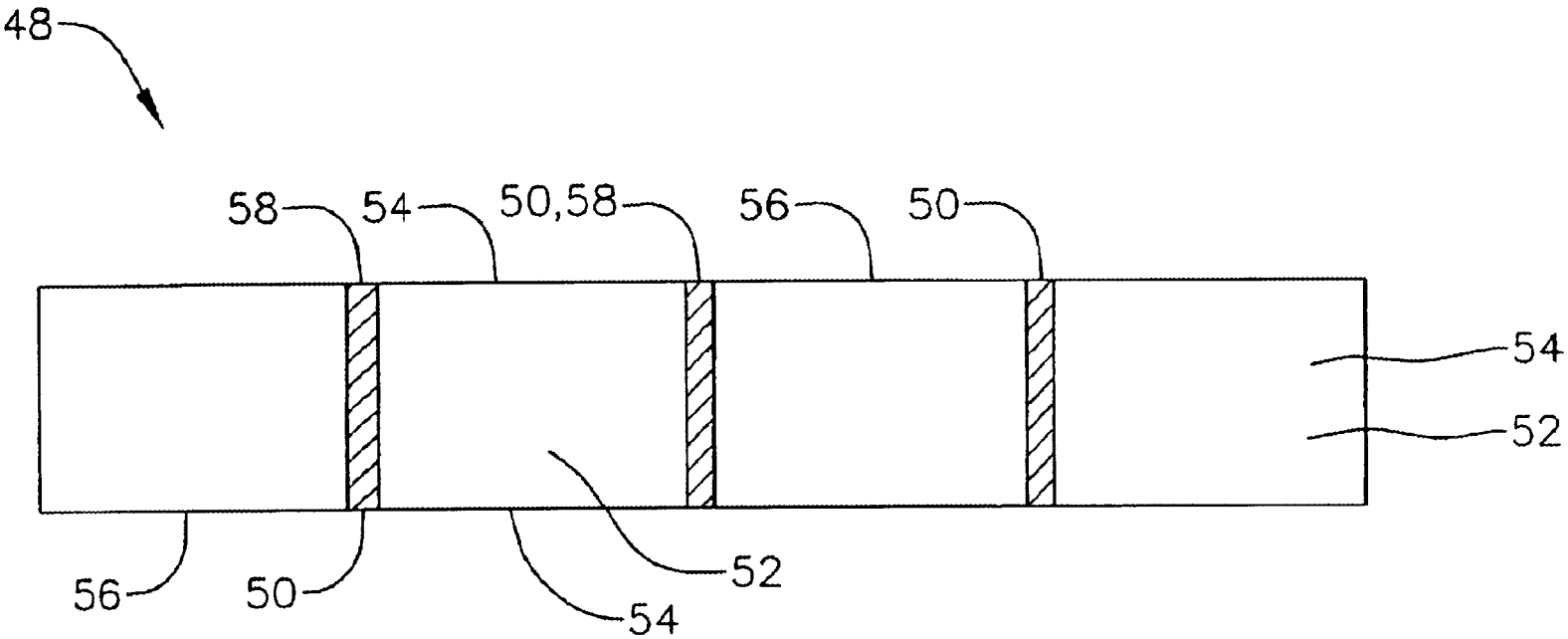
FIG. 5 shows another vent device of the present invetion.

Another embodiment of this invention is shown in FIG. 5, where a vent device 48 comprises a series of vertically oriented channels 50 disposed along a venting surface 52. The vent device 48 further comprises a mounting surface 54, which preferably comprises an adhesive backing designed to adjoin the vent device to the horizontal joists. It is understood, however, that attachment can be achieved by any convention method used, such as by hammer staples, nails, etc. The vent device is preferably a solid piece wherein the channels 50 are formed between a series of relatively thick members 56 being attached together by relatively thin members 58, wherein the thin members define the channels 50. The mounting surface 54 can also comprise a support flange 60 that serves to adjoin the vent device to the horizontal joists. The support flange can be positioned parallel to the channeling plate and comprise means for adjoining the channeling plate to the horizontal joist.

Similar to the other venting devices of this invention, the venting device 48 is designed for placement between the front surface of the horizontal joist and the inner surface of the wallboard. Furthermore, the channels 50 provide a passageway 60 that allows moisture and air within the wall structure to travel in order to prevent moisture accumulation and mold. The vent device is also easily adapted to accommodate various sizes and shapes, such as being able to conform to the side edges of the horizontal joists. The mounting surface could also be nonadhesive and instead simply be adjoined to the horizontal joist with traditional attachment means, such as nails, hammer staples, screws, staples, etc. Also, any suitable materials can be used to construct the vent device.

In addition to the specific features and embodiments described above, it is understood that the present invention includes all equivalents to the structures and features described herein, and is not to be limited to the disclosed embodiments. For example, the sizing and materials used to construct the vent device can be varied depending on the specific application, as can the construction of the wall structure to which the vent device is incorporated. For example, the structural relationship between the channeling plate and the support flange were shown and described as being substantially perpendicular. This relationship can be modified to accommodate any dimension wall structure, such as curved or circular wall joists. Additionally, individuals skilled in the art to which the present vent device pertains will understand that variations and modifications to the embodiments described can be used beneficially without departing from the scope of the invention.

What is claimed is:

1. A vent device for promoting air and moisture circulation within a wall structure comprising:

a channeling plate having a mounting surface on one side thereof and a venting surface facing opposite the mounting surface and having a plurality of vertically oriented channels located in the venting surface; and a support flange adjoined to the channeling plate and oriented substantially perpendicular to the channeling plate;

wherein the channeling plate is positioned between a horizontal joist and a wallboard and the vertically oriented channels define a passage way for air and water to travel along when the vent device is disposed in the wall structure.

2. The vent device of claim 1 wherein the passageway allows air and moisture to travel between the horizontal joist and the wallboard.

3. The vent device of claim 2 wherein the support flange rests against one of a top surface of the horizontal joist or a bottom surface of the horizontal joist.

4. The vent device of claim 3 further comprising a second channeling plate extending from the support flange, wherein the channeling plate and the second channeling plate are substantially parallel.

5. The vent device of claim 4 wherein the support flange of the vent device is adapted for placement against a horizontal joist, wherein the passageways of each channeling plate allows air and moisture to travel between the horizontal joist and surfaces facing each side of the horizontal joist.

6. A vent device for preventing mold within a wall structure comprising:

a channeling plate having a plurality of vertically oriented channels; and a support flange extending from the channeling plate;

wherein positioning the channeling plate between a horizontal joist and a wallboard provides a passageway along the vertically oriented channels.

7. The vent device of claim 6 wherein the support flange extends substantially perpendicular from the channeling plate.

8. The vent device of claim 7 wherein the support flange rests against one of a top surface of the horizontal joist and a bottom surface of the horizontal joist.

9. The vent device of claim 6 wherein the channeling plate further comprises a mounting surface and a venting surface facing opposite the mounting surface, wherein the venting surface comprises the passageway.

10. The vent device of claim 9 wherein the passageway promotes air and moisture circulation between the horizontal joist and the wallboard.

11. The vent device of claim 10 further comprising a second channeling plate extending from the support flange, wherein the channeling device and the second channeling device are substantially parallel.

* * * * *